United States Patent [19]

Yamamoto et al.

[11] Patent Number: 4,653,594

[45] Date of Patent: Mar. 31, 1987

[54] VIBRATION GENERATING APPARATUS

[75] Inventors: Hiroshi Yamamoto, Ibaraki; Shuichi Satoh, Sendai; Yoshiyuki Iwai, Takamatsu; Osamu Ae, Kyoto; Masao Suda, Tsuchiura; Minoru Shiozaki, Ibaraki; Kiyoshi Tsuchiya, Ibaraki; Manabu Nakano, Ibaraki; Kojiro Ogata, Ishioka; Naoki Miyanagi, Ibaraki; Kozo Ono, Toride; Nobuyuki Tobita, Mito, all of Japan

[73] Assignees: Nippon Telegraph & Telephone Public Corporation; Hitachi, both of Tokyo, Japan

[21] Appl. No.: 614,678

[22] Filed: May 29, 1984

[30] Foreign Application Priority Data

May 26, 1983 [JP] Japan ..... 58-91546
May 26, 1983 [JP] Japan ..... 58-91547

[51] Int. Cl.[4] ..... E02D 7/18

[52] U.S. Cl. ..... 173/49; 175/55; 405/184

[58] Field of Search ..... 173/49, 113, 162 R, 173/105, 91; 74/61; 175/55, 56, 61, 345; 403/56, 57, 76, 78, 114, 122, 124, 125; 405/184; 299/55, 58

[56] References Cited

U.S. PATENT DOCUMENTS 658,516 9/1900 Smith ..... 403/122
2,475,385 7/1949 Frisco ..... 279/16
2,951,681 9/1960 Degen ..... 175/56
3,800,889 4/1974 Bauer ..... 175/55
3,926,267 12/1975 Svirschevsky et al. ..... 175/55

FOREIGN PATENT DOCUMENTS 1126668 11/1984 U.S.S.R. ..... 173/91

*Primary Examiner*—Donald R. Schran
*Assistant Examiner*—James L. Wolfe
*Attorney, Agent, or Firm*—Antonelli, Terry & Wands

[57] ABSTRACT

A vibration generating apparatus including a support body having a first center axis, a first spherical joint element provided at a forward end of the support body and having the center of a sphere located on the first center axis, a vibrating body having a second center axis passing through the sphere center, a second spherical joint element provided on the vibrating body and concentric complementary with the first spherical joint element to cooperate therewith to allow the vibrating body to be supported on the support member for universal movement, a rotary shaft coaxially rotatably supported within the vibrating body, a pair of eccentric weights mounted on the rotary shaft with a phase deviation of 180 degrees and in a manner symmetrical with respect to the sphere center, and a drive motor connected to the rotary shaft for driving same for rotation whereby the pair of eccentric weights are rotated about the second center axis to cause the vibrating body to move in conical motion vibration such that the second center axis describes a circular cone having a vertex located at the sphere center about the first center axis.

7 Claims, 12 Drawing Figures

VIBRATION GENERATING APPARATUS

BACKGROUND OF THE INVENTION

(1) FIELD OF THE INVENTION

This invention relates to vibration generating apparatus suitable for use with vibration type pipe laying systems, vibration type pile impacting systems, vibration type compacting machines, etc., and more particularly it is concerned with a vibration generating apparatus which generates, while producing a thrust (a force acting in the direction of a center axis of vibration type pipe laying system, a vibration type pile impacting system or a vibration type compacting machine), a vibratory force directed substantially perpendicular to the thrust.

(2) DESCRIPTION OF THE PRIOR ART

One example of the vibration generating apparatus of the prior art is disclosed in Japanese Patent Application Laid-Open No. 123392/82 as being suitable for use with a vibration type pipe laying system.

This type of vibration generating apparatus of the prior art comprises a support and vibrating body generally formed in a cylindrical configuration and provided with a forward end portion of a conical shape, a rotary shaft coaxially rotatably mounted within the support and vibrating body and having an eccentric weight mounted thereon, and a drive motor connected to the rotary shaft. Actuation of the drive motor causes the rotary shaft to rotate about its center axis and causes the support and vibrating body to vibrate in a direction substantially perpendicular to the center axis of the rotary shaft by virtue of the eccentric weight supported on the rotary shaft.

The vibration generating apparatus of the aforesaid construction is connected at a rearward end of the support and vibrating body to a forward end of a foremost one of a plurality of pipes to be laid underground, with a rearward end of a rearmost one of the plurality of pipes to be laid being connected to a presser device located in a starting pit. Thus, the vibration generating apparatus is set into a vibration type pipe laying system. The vibratory force generated by the vibration generating apparatus would reduce firmness of the ground and allow the pipes to be laid to be pressed forwardly by the presser device toward a destination pit. The vibration type pipe laying system incorporating therein the vibration generating apparatus of the aforesaid construction offers the advantage that it is higher in operation efficiency than a press-in type pipe laying system wherein pipes to be laid are directly pressed by a presser device and propelled. Additionally, the presser device used with the vibration type pipe laying system can be smaller in size than that used with the press-in type pipe laying system. By supplying a viscosity imparting liquid through the leading end of the support and vibrating body, soil particles produced as the ground is loosened and crushed by the vibration generating apparatus are mixed with the viscosity imparting liquid to form a slurry which fills the gap between the vibration generating apparatus and the pipes to be laid and the ground, so that the frictional resisting force exerted by the ground to the apparatus and the pipes is further reduced. This is conducive to improved operation efficiency and permits a compact size to be obtained in a presser device.

Some disadvantages are associated with the vibration generating apparatus of the aforesaid construction of the prior art. In this apparatus, the support and vibrating body vibrates as a whole. Thus, when pipes to be laid are connected to the support and vibrating body, the vibration generating apparatus is connected to the pipes to be laid in rigid coupling, so that the vibration of the apparatus would be directly transmitted to the pipes to be laid. This cause a portion of the vibration generated by the apparatus to extend to the pipes to be laid, and therefore the concurrent vibration of these members makes it necessary to increase the size of the vibration generating apparatus to obtain a necessary vibratory force of a high magnitude at the support and vibratory body.

The vibration generating apparatus under discussion would suffer the aforesaid disadvantage also when it is incorporated in a vibration type pile impacting system or a vibration type compacting machine, because the vibration of the apparatus would be transmitted to other parts of the vibration type pile impacting system or vibration type compacting machine.

To obviate the aforesaid disadvantage, a vibration generating apparatus has been developed which is capable of preventing the vibration from being transmitted to the pipes to be laid and other parts of the pipe laying system.

Japanese Patent Application Laid-Open No. 146896/82 discloses this type of vibration generating apparatus as incorporated in a vibration type pipe laying system. This vibration generating apparatus comprises a support body formed in a generally cylindrical configuration, a vibrating body having a forward end portion of a conical shape and a substantially cylindrical portion coaxially inserted in the cylindrical support body, a plurality of vibration absorbing rods of a small diameter for connecting a rearward end of the vibrating body to a forward end of the support body, the rods having opposite ends fixed to the rearward end of the vibrating body and the forward end of the support body in such a manner that the plurality of rods are arranged in a circle concentric with the support body and cylindrical portion of the vibrating body, and a bellows-like member of a resilient material interposed between the forward end of the support body and a rear surface of the conical forward end portion. A rotary shaft is coaxially rotatably mounted in the cylindrical portion of the vibrating body and mounts thereon an eccentric weight, and a drive motor is connected to the rotary shaft. A vibration type pipe laying system provided with this vibration generating apparatus offers the same advantages as the vibration type pipe laying system provided with the vibration generating apparatus of the prior art described previously.

An additional advantage offered by the last mentioned vibration generating apparatus is that the provision of the rods of a small diameter between the support body and vibrating body enables vibration of the vibrating body (vibration directed perpendicular to the axis of the support body and the cylindrical portion of the vibrating body) to be absorbed by deflection of the rods of the small diameter from the axis of the support body and the cylindrical portion of the vibrating body, while a thrust is applied by the presser device to the vibrating body, so that the vibration of the vibrating body is not transmitted to the pipes to be laid through the support body. Stated differently, the vibrating body is connected to the pipes to be laid in flexible coupling through the support body and rods of the small diameter. Thus, the disadvantage of the first mentioned vibration generating apparatus that it should be large in size to produce a vibratory force of a high magnitude because its vibration is transmitted to pipes to be laid when it is incorporated in a vibration type pipe laying system and to other parts when it is incorporated in a vibration type pile impacting system or a vibration type compacting machine is eliminated.

However, in the last mentioned vibration generating apparatus wherein the rods of a small diameter are provided to serve as vibration absorber means, another problem has been raised. That is, since the rods of a small diameter interposed between the support body and vibrating body must bear a thrust applied by the presser device, the rods might be ruptured when the thrust applied thereto is high in magnitude.

SUMMARY OF THE INVENTION

(1) OBJECT OF THE INVENTION

This invention has as its object the provision of a vibration generating apparatus which allows vibration generated not to be transmitted to pipes to be laid or other parts of a system in which the vibration generating apparatus is incorporated, so that it is possible to eliminate a loss of a vibratory force, and which is capable of bearing a thrust of a high magnitude applied thereto.

(2) STATEMENT OF THE INVENTION

According to the invention, there is provided a vibration generating apparatus comprising a support body having a first center axis, a first spherical joint element provided at a forward end of the support body and having the center of a sphere located on the first center axis, a vibrating body having a second center axis passing through the sphere center of the first spherical joint element, a second spherical joint element provided on the vibrating body, the second spherical joint element being concentric and complementary with the first spherical joint element and cooperating therewith to allow the vibrating body to be supported on the support body for universal movement, a rotary shaft coaxially rotatably supported within the vibrating body, a pair of eccentric weights mounted on the rotary shaft in such a manner that they deviate from each other in phase by 180 degrees and are symmetrical with respect to the sphere center of the first and second spherical joint elements, and drive means connected to the rotary shaft for driving same for rotation whereby the pair of eccentric weights are rotated about the second center axis to cause the vibrating body to move in conical motion vibration such that the second center axis describes about the first center axis a circular cone having a vertex located at the sphere center of the first and second spherical joint elements.

In the vibration generating apparatus of the aforesaid construction, the vibrating body is preferably constructed such that the center of gravity of the vibrating body is located on or rearward of the sphere center of the first and second spherical joint elements.

DESCRIPTION OF THE PREFERRED EMBODIMENT

Figure 1:
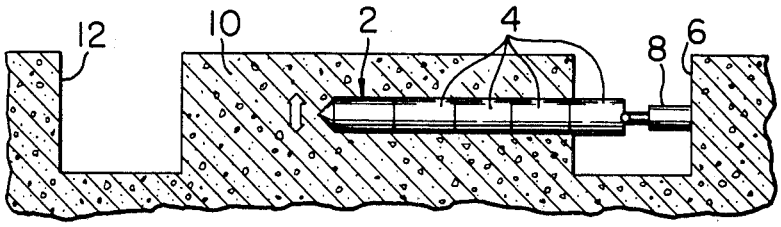
FIG. 1 is a side view of a vibration type pipe laying system incorporating therein the vibration generating apparatus according to the invention, showing the manner in which the system is set in position for operation.

In FIG. 1, there is shown a vibration type pipe laying system 2 incorporating therein a preferred embodiment of the vibration generating apparatus in conformity with the invention. The vibration generating apparatus 2 has connected to its rearward end a forward end of a foremost one of a plurality of pipes 4 to be laid, and a rearward end of a rearmost one of the pipes 4 to be laid is connected to a presser device 8 located in a starting pit 6. Thus, the vibration type pipe laying system is set in position for operation. The vibration generating apparatus generates a vibratory force when operated to reduce the firmness of the ground 10 by vibration transmitted thereto while the presser device 8 is actuated to propel the pipes 4 toward a destination pit 12.

Figure 2:
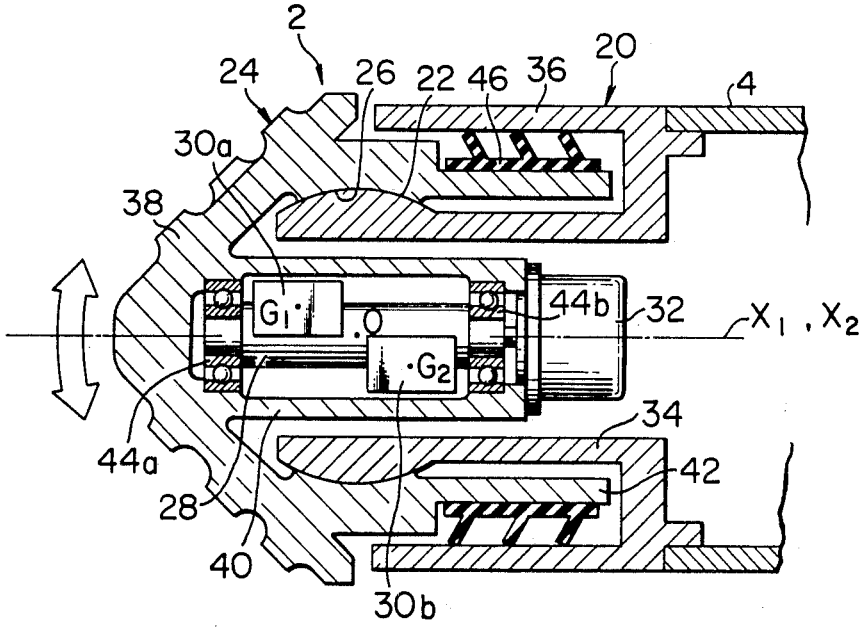
FIG. 2 is a sectional side view of the vibration generating apparatus comprising one embodiment of the invention.

The construction of the vibration generating apparatus will be described by referring to FIG. 2. As shown, the vibration generating apparatus 2 comprises a support body 20 having a first center axis $X_1$ connected at its rearward end to the forward end of the foremost pipe 4 to be laid. A first spherical joint element 22 having the center of a sphere at O located on the first center axis $X_1$ is provided at the forward end of the support body 20. The vibration generating apparatus 2 comprises a vibrating body 24 having a second center axis $X_2$ passing through the sphere center 0. A second spherical joint element 26 concentric and complementary with the first spherical joint element 20 is provided on the vibrating body 24 and cooperates with the first spherical joint element 22 to allow the vibrating body 24 to be supported on the support body 22 for universal movement. A rotary shaft 28 coaxial with the vibrating member 24 is rotatably supported within the vibrating body 24, and a pair of eccentric weights 30*a* and 30*b* are mounted on the rotary shaft 28 in such a manner that the eccentric weights 30*a* and 30*b* deviate from each other in phase by 180 degrees and are symmetrical with respect to the sphere center 0. Drive motor 32 is connected to the rotary shaft 28 to drive same for rotation.

Preferably, the support body 20 is in the form of a dual cylindrical structure having a first inner cylindrical portion 34 and a first outer cylindrical portion 36 open at their forward ends and closed at their rear ends. The first spherical joint element 22 comprises a convex spherical surface portion having the center of a sphere 0 and formed at an outer peripheral surface of a forward end portion of the first inner cylindrical portion 34. The vibrating body 24 includes a forward end portion 38 of a conical shape and a dual cylindrical structure portion having a second inner cylindrical portion 40 and a second outer cylindrical portion 42 extending rearwardly from the conical forward end portion 38 and open at their rearward ends. The second spherical joint element 26 comprises a concave spherical surface portion formed on an inner peripheral surface of a forward end portion of the second outer cylindrical portion 42 to be concentric with the convex spherical surface portion 22. The second inner cylindrical portion 40 of the vibrating body 24 is inserted within the first inner cylindrical portion 34 of the support body 20 and the second outer cylindrical portion 42 thereof is inserted between the first inner cylindrical portion 34 and the first outer cylindrical portion 36 of the support body 20 with the concave spherical surface portion 26 of the vibrating body 24 in contact with the convex spherical surface portion 22 of the support body 20. The rotary shaft 28 is coaxially rotatably supported within the second inner cylindrical portion 40 of the vibrating body 24 with bearings 44*a* and 44*b* at opposite end portions thereof. The drive motor 32 is connected to a rear end of the rotary shaft 28 and mounted at a rear end of the second inner cylindrical portion 40 of the vibrating body 24. An annular seal member 46 formed of a flexible material is interposed between the first outer cylindrical portion 36 of the support body 20 and the second outer cylindrical portion 42 of the vibrating body 24.

In the vibration generating apparatus 2 of the aforesaid construction, actuation of the drive motor 32 causes the rotary shaft 28 to rotate, which in turn causes the pair of eccentric weights 30*a* and 30*b* mounted on the rotary shaft to rotate on opposite sides of the sphere center 0 of the convex and concave spherical surface portions 22 and 26 with deviation in phase by 180 degrees from each other. This rotation of the eccentric weights 30*a* and 30*b* generates a vibratory moment which causes the vibrating body to move in conical motion vibration about the sphere center 0 of the convex and concave spherical surface portions 22 and 26 as described in detail later to thereby reduce the firmness of the ground 10 to facilitate propulsion of the pipes 40 to be laid underground. More specifically, the rotation of the rotary shaft 28 causes the pair of eccentric weights 30*a* and 30*b* to rotate and generate centrifugal forces, with the centrifugal force generated by the forward eccentric weight 30*a* and the centrifugal force generated by the rearward eccentric weight 30*b* acting upwardly and downwardly respectively in the plane of FIG. 2 and providing a couple which, is, transmitted to the vibrating body 24. Since the couple has its center coinciding with the sphere center 0 of the convex and concave spherical surface portions 22 and 26, the vibrating body 24 is caused by the couple to move in conical vibratory motion in such a manner that the second axis $X_2$ describes about the first axis $X_1$ a circular cone having a vertex at the sphere center 0 of the convex and concave spherical surface portions 22 and 26.

Figure 3A:
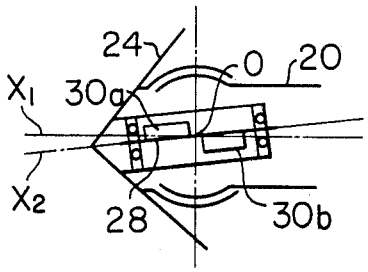
FIGS. 3*a*–3*d* are views for explanation of the conical motion vibration of the vibrating body shown in FIG. 2.
Figure 4A:
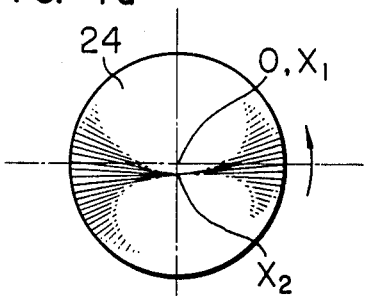
FIGS. 4*a*–4*d* are views corresponding to FIGS. 3*a*–3*d*, respectively, but viewed at the front of the support body.
Figure 3B:
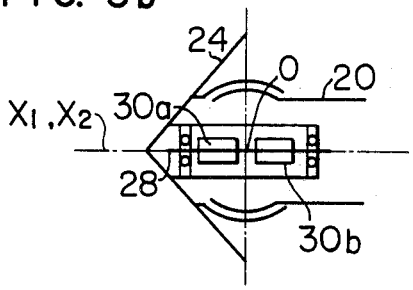
Figure 4B:
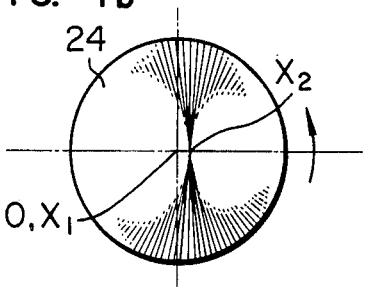
Figure 3C:
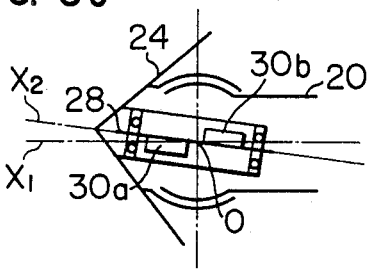
Figure 4C:
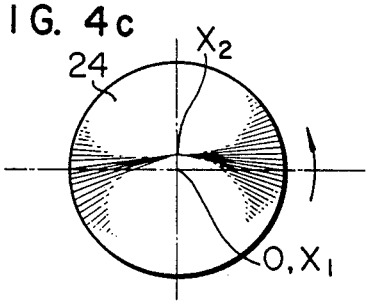
Figure 3D:
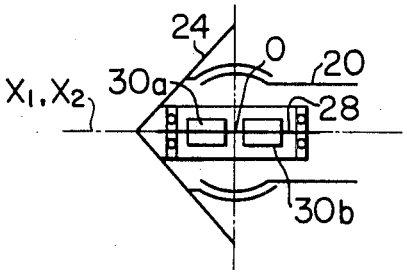
Figure 4D:
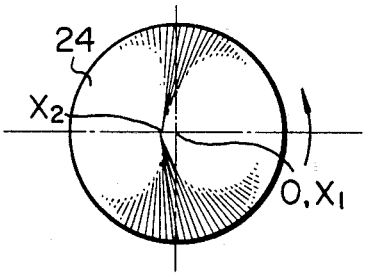

The conical vibratory motion of the vibrating body 24 will be described more in detail by referring to FIGS. 3*a*–3*d* and 4*a*–4*d*. Assume that the rotary shaft 28 rotates counterclockwise as indicated by an arrow in FIGS. 4*a*–4*b* as viewed toward the front of the vibrating body 24. At this time, if the forward eccentric weight 30*a* is disposed in an upper position and the rearward eccentric weight 30*b* is disposed in a lower position, then the axis $X_2$ of the vibrating body 24 is disposed downwardly about the sphere center 0 of the convex and concave spherical surface portions 22 and 26 with respect to the axis $X_1$ of the support body 20, as shown in FIGS. 3*a* and 4*a*. Then, as the forward eccentric weight 30*a* is disposed in a leftward position and the rearward eccentric weight 30*b* is disposed in a rightward position as viewed toward the front of the vibrating body 24, the axis $X_2$ of the vibrating body 24 is directed rightwardly about the sphere center 0 of the convex and concave spherical surface portions 22 and 26 with respect to the axis $X_1$ of the support body 20, as shown in FIGS. 3*b* and 4*b*. *Subsequently, as the forward eccentric weight 30a* is disposed in a lower position and the rearward eccentric weight 30*b* is disposed in an upper position, the axis $X_2$ of the vibrating body 24 is directed upwardly about the sphere center 0 of the convex and concave spherical surface portions 22 and 26 with respect to the axis $X_1$ of the support body 20, as shown in FIGS. 3*c* and 4*c*. Finally, as the forward eccentric weight 30*a* is disposed in a rightward position and the rearward eccentric weight 30*b* is disposed in a leftward position, the axis $X_2$ of the vibrating body 24 is directed leftwardly about the sphere center 0 of the convex and concave spherical surface portions 22 and 26 with respect to the axis $X_1$ of the support body 20, as shown in FIGS. 3*d* and 4*d*. As the vibrating body 24 moves continuously in the aforesaid conical vibratory motion, the vibrating body 24 moves in vertically directed oscillating motion as viewed in a section taken along the axis $X_1$ of the support body 20 as shown in FIGS. 3*a*–3*d*, with the conical forward end portion 38 of the vibrating body 24 in counterclockwise rotary motion as viewed toward the front of the vibrating member as shown in FIGS. 4*a*–4*d*. Stated differently, the vibrating body 24 is caused to move in specific motion such that the axis $X_2$ of the vibrating body 24 describes about the axis $X_1$ of the support body 20 a circular cone having a vertex located at the sphere center 0 of the convex and concave spherical surface portions 22 and 26. In this specification, the vibration generated by the aforesaid specific motion of the vibrating body 24 shall be referred to as conical motion vibration.

As described hereinabove, the vibrating body 24 is caused to move in conical motion vibration about the sphere center 0 of the convex and concave spherical surface portions 22 and 26, so that the vibration of the vibrating body 24 is absorbed at the convex and concave spherical Surface portions 22 and 26, and therefore is substantially not transmitted to the pipes 4 to be laid through the support body 20. Thus, the need to increase the size of the apparatus to allow a vibratory force of a high magnitude to be generated which must be met in the first mentioned vibration generating apparatus of the prior art can be eliminated. Also, the vibrating body 24 is connected to the support body 20 through a spherical joint coupling composed of the convex and concave spherical surface portions 22 and 26 and a thrust applied to the vibration generating body 24 is borne by the convex and concave spherical surface portions 22 and 26. Thus the apparatus can bear a thrust of a high magnitude without the trouble of the vibration absorbers in the form of rods of small diameter being ruptured as happened in the last mentioned vibration generating apparatus of the prior art.

In the vibration generating apparatus according to the invention, the vibrating body 24 is preferably constructed such that the center of gravity is located on or rearward of the sphere center 0 of the convex and concave spherical surface portions 22 and 26 constituting the first and second spherical joint elements, respectively. The reason why such construction is preferred will be described by referring to FIGS. 5 and 6.

Figure 5:
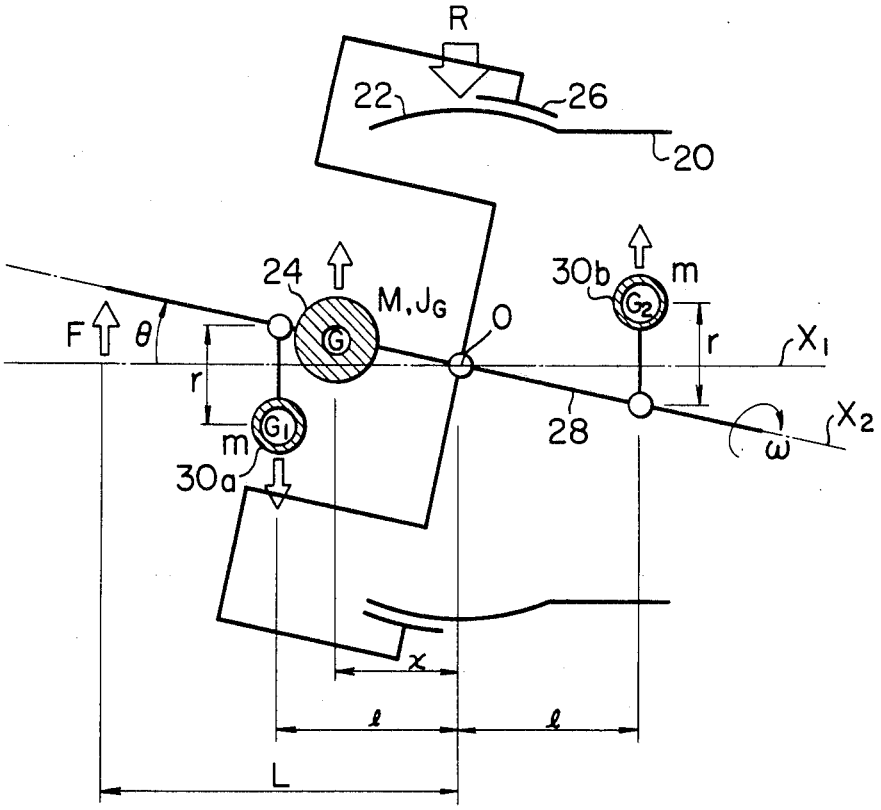
FIG. 5 is a view for explanation of the optimum position of the center of gravity of the vibrating body.

Referring FIG. 5, when the conical forward end portion 38 of the vibrating body 24 is caused to move in conical motion vibration, a reaction force R is transmit.ted to the support body 20 through the convex and concave spherical surface portions 22 and 26. The reaction force R will be determined in relation to the position of the sphere center 0 of the convex and concave spherical portions 22 and 26, the position of the center of gravity G of the vibrating body 24, the resisting force offered by the ground 10, etc.

The characters shown in FIG. 5 designate the following:

G: the center of gravity of vibrating body 24.

x: the distance between the center of gravity G of vibrating body 24 and the sphere center 0 of convex and concave spherical surface portions 22 and 26.

M: the mass of vibrating body 24.

$J_G$: the moment of inertia of the vibrating body 24 passing through the center of gravity G of vibrating body 24 and with respect to an axis perpendicular to the plane of FIG. 5.

$G_1$, $G_2$ the centers of gravity of the pair of eccentric weights 30*a* and 30*b*, respectively.

l: the distance between the centers of gravity $G_1$ and $G_2$ of the pair of eccentric weights 30*a* and 30*b* and the sphere center 0 of convex and concave spherical surface portions 22 and 26.

r: the distance between the centers of gravity $G_1$ and $G_2$ of the pair of eccentric weights 30*a* and 30*b* and the center axis $X_2$ of rotary shaft 28, or the eccentricity.

m: the masses of the pair of eccentric weights 30*a* and 30*b*, respectively.

F: the resisting force offered by the ground 10 to vibrating body 23.

L: the distance between the position in which the resisting force F offered by the ground 10 acts on vibrating body 24 and the sphere center 0 of the convex and concave spherical surface portions 22 and 26.

R: the force to be borne by convex and concave spherical surface portions 22 and 26, or reaction force.

$\omega$: the number of revolutions of the pair of eccentric weights 30*a* and 30*b* (rotary shaft 28).

$\theta$: the angle of oscillation of vibrating body 24 with respect to support body 20, or the angle formed by the axes $X_1$ and $X_2$.

First, movements about the sphere center 0 of the convex and concave spherical surface portions 22 and 26 are expressed by the following equation:

$$(J_G + Mx^2)\omega^2\theta = 2m(r - l\theta)\omega^2 \cdot l - FL \quad (1)$$

$$\therefore \theta = \frac{2mrl}{J_G + Mx^2 + 2ml^2}\left(1 - \frac{FL}{2mrl\omega^2}\right)$$

Next, the balance of forces is expressed by the following equation:

$$F - m(r - l\theta)\omega^2 + M(x\theta)\omega^2 - R + m(r - l\theta)\omega^2 = 0$$

$$\therefore R = F + Mx\theta\omega^2 \quad (2)$$

By substituting equation (1) into equation (2), the following equation is obtained:

$$R = F\left(1 - \frac{MLx}{J_G + Mx^2 + 2ml^2}\right) + \frac{2mrlMx\omega^2}{J_G + Mx^2 + 2ml^2} \quad (3)$$

As can be seen clearly from equation (3), the reaction force R transmitted to the convex and concave spherical surface portions 22 and 26 may vary depending on the resisting force F offered by the ground 10 and the position x of the center of gravity G of the vibrating body 24. This relation is shown in FIG. 6.

Figure 6:
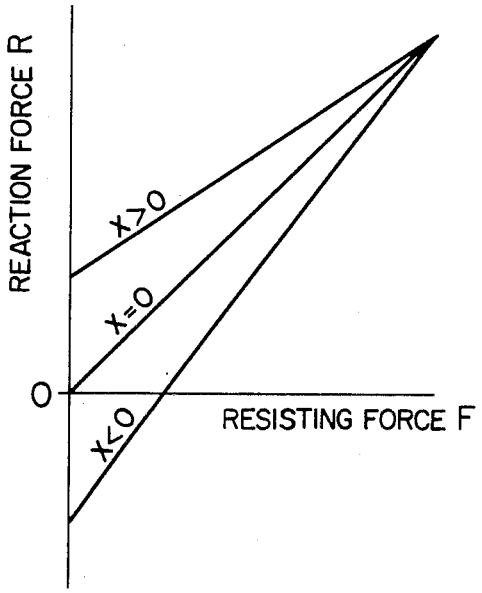
FIG. 6 is a diagrammatic representation of changes in reaction force caused by the position of the center of gravity of the vibrating body.

In FIG. 6 which shows a diagrammatic representation of changes in the reaction force R caused by the position x of the center of gravity G of the vibrating body 24, the abscissa represents the resisting force F offered by the ground 10 which acts on the conical forward end portion 38 of the vibrating body 24, and the ordinate indicates the reaction force R acting on the convex and concave spherical surface portions 22 and 26. As can be clearly seen in the graph shown in FIG. 6, when $x=0$ or when the center of gravity G coincides with the sphere center 0, $R=F$ or the reaction force R becomes equal to the resisting force offered by the ground 10. When $x>0$ or when the center of gravity G is nearer to the conical forward end portion 38 of the vibrating body 24 than the sphere center 0, the reaction force R exists even if $F=0$ and increases with an increase in the resisting force F. When $x<0$ or when the center of gravity G is farther from the conical forward end 38 of the vibrating body 24 than the sphere center 0 (nearer to the rearward end of the support body 20), the reaction force R shows a change in such a manner that it rises from a negative value and its absolute value decreases with an increase in the resisting force F but increases after $R=0$ as the resisting force F reaches a certain value. It will be seen that the reaction force R transmitted to the convex and concave spherical surface portions 22 and 26 undergoes a change which may vary depending on where the center of gravity G of the vibrating body 24 is located.

Let us now discuss the position of the center of gravity G of the vibrating body 24 which would be most advantageous for the vibration generating apparatus 2.

It should be noted that what is important in this connection is the absolute value (size) of the reaction force R and not whether it is positive or negative (direction). When $x>0$, at least F is not equal to 0 and the reaction force R has a greater absolute value than when $x \leqq 0$, as can be clearly seen in FIG. 6. Meanwhile, if $x=0$, when $F=0$, $R=0$, so that no reaction force R would be produced at least during a no load operation. Furthermore, if $x<0$, the reaction force R is produced when $f=0$, but the absolute value of R decreases as the value of F increases. Essentially, the vibration generating apparatus does work against the resisting force F offered by the ground 10 and the presence of the resisting force F offered by the ground 10 is taken for granted. Thus, the characteristic of $x<0$ that would make R equal to 0 at a predetermined value of the resisting force F offered by the ground would be a desirable characteristic for the vibration generating apparatus.

The foregoing discussion leads to the conclusion that the center of gravity G of the vibrating body 24 would be advantageously located at the sphere center 0 of the convex and concave spherical surface portions 22 and 26 or in a position rearward of the sphere center 0, or remote from the conical forward end portion 38 of the vibrating body 24 to minimize the reaction force R produced in the convex and concave spherical surface portions 22 and 26.

In the foregoing description of the embodiment of the invention, the invention has been described as being incorporated in a vibration type pipe laying system. It will be appreciated, however, that the same effects as achieved in this embodiment could also be achieved when the invention is incorporated in a vibration type pile impacting system, a vibration type compacting machine or some other similar system or machine.

From the description of the embodiment set forth, hereinabove, it will be appreciated that in the vibration generating apparatus according to the invention, the vibrating body is supported by the support body through the pair of spherical joint elements, and the rotary shaft coaxially rotatably mounted in the vibrating body and mounting thereon a pair of eccentric weight located in such a manner that they deviates from each other in phase by 180 degrees and are symmetrical with respect to the sphere center of the spherical joint elements is connected to drive means. As the drive means is actuated, the rotary shaft rotates and the pair of eccentric weights mounted on the rotary shaft also rotate and generate a vibratory moment which causes the vibrating body to move in conical motion vibration about the sphere center of the spherical joint elements, without the conical motion vibration of the vibrating body being transmitted to the pipes to be laid through the support body. This eliminates the need to increase the size of the apparatus to generate a vibratory force of a high magnitude which must be met in the first mentioned vibration generating apparatus of the prior art in which vibration is transmitted to the pipes to be laid. Also, since the spherical joint elements are provided to connect the vibrating body and support body together, the vibrating body can bear a thrust of a high magnitude without the trouble of the vibration absorbers being ruptured as happened in the last mentioned vibration generating apparatus of the prior art which uses rods of a small diameter as the vibration absorbers.

It will be also appreciated that in the vibration generating apparatus according to the invention, the vibrating body is constructed such that the center of gravity of the vibrating body is located on the sphere center of the spherical joint elements or in a position rearward thereof. This is conducive to minimization of the reaction force transmitted from the vibrating body through the spherical joint elements to the support body.

What is claimed is:

1. A vibration generating apparatus comprising:
- a support body having a first center axis;
- a first spherical joint element provided at a forward end of said support body and having the center of a sphere located on said first center axis;
- a vibrating body having a second center axis passing through the sphere center of said first spherical joint element;
- a second spherical joint element provided on said vibrating body, said second spherical joint element being concentric and complementary with the first spherical joint element and cooperating therewith to allow the vibrating body to be supported on the support body for universal movement;
- a rotary shaft coaxially rotatably supported within the vibrating body;
- a pair of eccentric weights mounted on the rotary shaft in such a manner that they deviate from each other in phase by 180 degrees and are symmetrical with respect to the sphere center of the first and second spherical joint elements; and
- drive means connected to the rotary shaft for driving same for rotation whereby the pair of eccentric weights are rotated about the second center axis to cause the vibrating body to move in conical motion vibration such that the second center axis describes about the first center axis a circular cone having a vertex located at the sphere center of the first and second spherical joint elements.

2. A vibration generating apparatus as claimed in claim 1, wherein said first spherical joint element comprises a convex spherical surface portion and said second spherical joint element comprises a concave spherical surface portion in engagement with said convex spherical surface portion.

3. A vibration generating apparatus as claimed in claim 1, wherein said vibrating body includes a forward end portion of a conical shape, and a cylindrical portion extending rearwardly from said forward end portion into the interior of said support body, said rotary shaft being coaxially rotatably mounted in said cylindrical portion.

4. A vibration generating apparatus as claimed in claim 1, wherein said support body is in the form of a dual cylindrical structure having a first inner cylindrical portion and a first outer cylindrical portion open at their forward ends and closed at there rearward ends, said first spherical joint element being formed on a forward end of said first inner cylindrical portion and a portion of said vibrating body inserted between the first inner and outer cylindrical portions of the support body, and further comprising flexible seal means mounted between said portion of the vibrating body and the first outer cylindrical portion of the support body.

5. A vibration generating apparatus as claimed in claim 4, wherein said vibrating body includes a forward end portion of a conical shape and a dual cylindrical structure portion having a second inner cylindrical portion and a second outer cylindrical portion extending rearwardly from said conical forward end portion and open at their rearward ends, said second inner cylindrical portion inserted within said first inner cylindrical portion of said support body and said rotary shaft being coaxially rotatably supported in the second inner cylindrical portion, said second outer cylindrical portion inserted between the first inner and outer cylindrical portions of the support body and said second spherical joint element being formed on an inner side of the second outer cylindrical portion so as to engage with said first spherical joint element, and further comprising flexible seal means mounted between said first and second outer cylindrical portions.

6. A vibration generating apparatus as claimed in claim 5, wherein said drive means is mounted at a rearward end of the second inner cylindrical portion of the vibrating body.

7. A vibration generating apparatus as claimed in claim 1, wherein said vibrating body is constructed such that the center of gravity of the vibrating body is located on or rearward of the sphere center of the first and second spherical joint elements.

* * * * *